United States Patent [19]

Lehnert

[11] Patent Number: 4,987,806

[45] Date of Patent: Jan. 29, 1991

[54] ELECTRONIC CONTROL CIRCUITRY FOR A NUTRUNNER

[75] Inventor: Mark W. Lehnert, Hoffman Estates, Ill.

[73] Assignee: GSE, Inc., Farmington Hills, Mich.

[21] Appl. No.: 568,537

[22] Filed: Aug. 15, 1990

Related U.S. Application Data

[63] Continuation of Ser. No. 309,406, Feb. 13, 1989, abandoned.

[51] Int. Cl.[5] ..... B25B 23/151

[52] U.S. Cl. ..... 81/469; 73/862.23; 173/12

[58] Field of Search ..... 81/467, 469; 73/862.21, 73/862.23, 862.26; 173/12

[56] References Cited

U.S. PATENT DOCUMENTS 4,669,319 6/1987 Heyraud ..... 73/862.23

4,813,312 3/1989 Wilhelm ..... 87/467

*Primary Examiner*—James G. Smith

*Attorney, Agent, or Firm*—Krass & Young

[57] ABSTRACT

Generally there is provided a nutrunner appliance for automatically driving a nut having an electrical motor, gearing, and a strain gauge to monitor the applied torque. The control system employs analog comparator circuits acting on analog signals from the strain gauge to determine the torque being applied. During operation, the comparator detects a predetermined torque and shifts the motor to a lower velocity to lower the inertia of the system. When the strain gauge output corresponds to the desired final torque, a braking action is applied to the motor to quickly terminate the applied torque.

10 Claims, 1 Drawing Sheet

ELECTRONIC CONTROL CIRCUITRY FOR A NUTRUNNER

This is a continuation of copending application Ser. No. 07/309,406 filed on Feb. 13, 1989, now abandoned.

BACKGROUND OF THE INVENTION

1. Field of the Invention

This invention relates to devices commonly referred to as nutrunners used in manufacturing for applying and securing nuts to bolts during assembly operations. More particularly, this invention relates to improvements in control circuitry for electrically operated nutrunner devices.

2. Description of the Prior Art

Electric nutrunner systems have generally employed a motor having means mounted thereto for engaging a nut and turning it onto a bolt. The system objective being to not only attach the nut quickly to the bolt but to secure the nut with a desired torque. During this sequence the rotational velocity of the nut and the applied torque changes rapidly and therefor it requires an accurate control system to obtain reliable results under the varying conditions encountered in manufacturing facilities.

Heretofore digital systems have been employed using well known digital sampling techniques. A torque is applied to the nut by means of an electric motor and maintained constant until the nut begins to tighten. The applied torque is periodically monitored and when the sampled torque reaches a predetermined level, indicating that the nut is tight, the applied torque is removed.

In such a digital system, during the short time interval occurring between the moment when the nut becomes tight and the moment the torque is removed, the tension on the bolt and the tightness of the nut changes dramatically. Since such changes occur at a rate much faster than conventional sampling circuitry can accurately respond, the selected desired tightness is often exceeded before the applied torque is again measured. This problem is often compounded when the system displays the last sampled applied torque as the actual finished condition, even though the inaccurate system yielded a much higher torque.

SUMMARY OF THE INVENTION

Accordingly it is a principal objective of the present invention to provide an electrically operated and controlled nutrunner, particularly adaptable as a hand held device, which provides increased accuracy and uniformity in operation by use of analog circuitry.

Generally there is provided a hand held nutrunner appliance having on one end an attachment for driving a nut and an electrical power connection at its other extremity. Within the appliance there is provided an electrical motor, gearing, and a strain gauge to monitor torque on the driven shaft. The control system employs analog comparator circuits acting on analog signals from the strain gauge to determine, continuously, the torque being applied. Moreover, during application of the nut to the bolt, the comparators detect a first predetermined strain and shift the motor to a lower velocity to lower the inertia of the system. Later, when the strain gauge output corresponds to the desired final torque, a braking action is applied to the motor and the applied torque is terminated.

Figure 1:
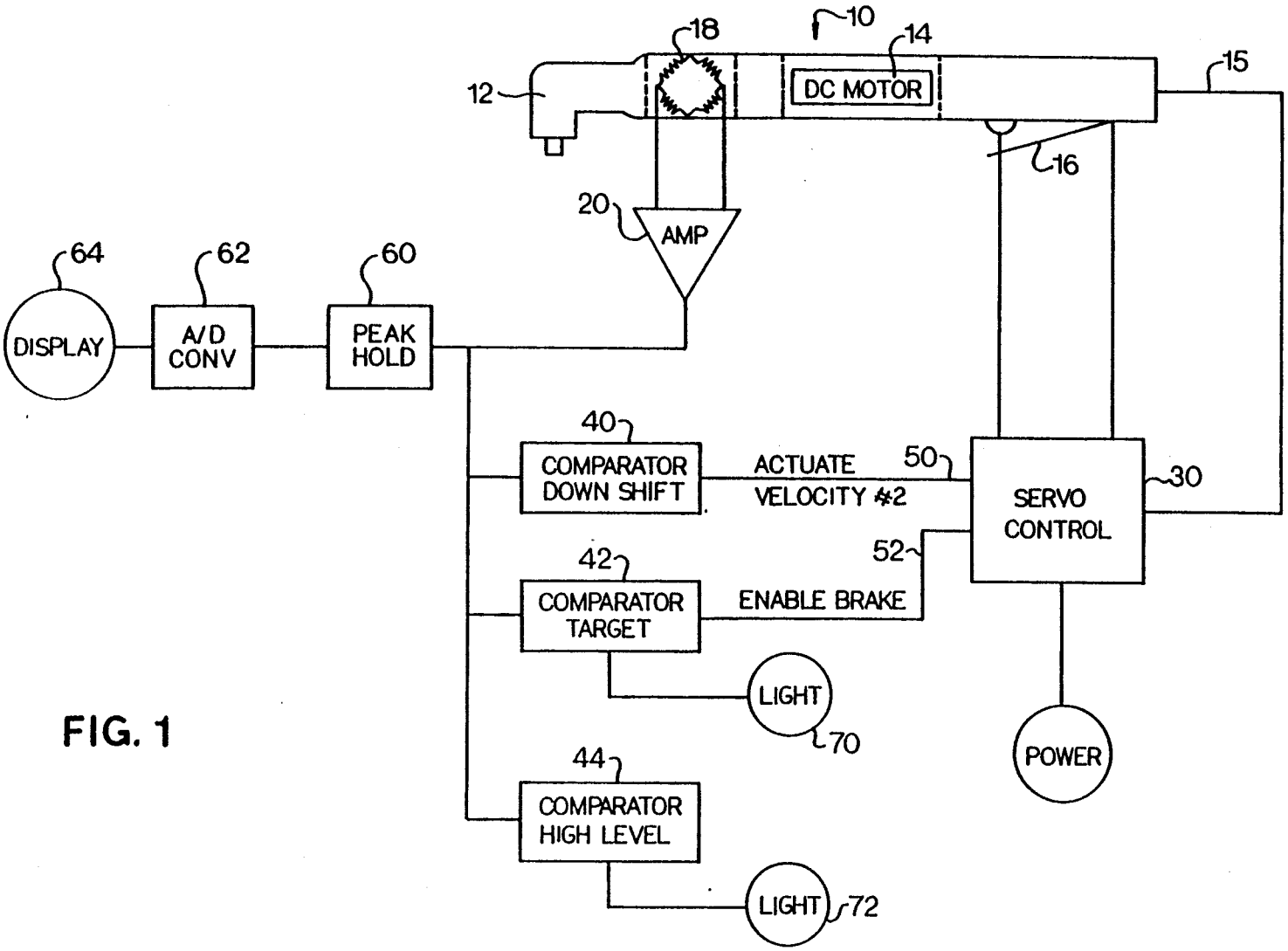
FIG. 1 is a block diagram of the electronic control of the present invention showing a DC motor driven hand held nutrunner device powered by an analog electronic control circuit.

While the invention will be described in connection with a preferred embodiment, it will be understood that I do not intend to limit the invention to that embodiment. On the contrary, I intend to cover all alternatives, modifications, and equivalents as may be included within the spirit and scope of the invention as defined by the appended claims.

DESCRIPTION OF THE PREFERRED EMBODIMENT

Turning now to the drawing, a representation of a nutrunner device 10 is generally indicated. A nut attachment end 12 is driven through appropriate gearing by the shaft of a DC motor 14. Controlled power, as hereinafter described, is provided to the motor through the power cable 15 in response to the closing of the manual switch 16.

Monitoring the torque being delivered through the shaft and gearing is a strain gauge 18 affixed to the drive shaft of the motor and arranged to provide a signal proportional to the applied torque. (While a specific location is shown, it is within the scope of this invention to locate this strain gauge anywhere along the drive of the device.) This torque representative signal obtained from the strain gauge is boosted in an amplifier 20 and then compared to predetermined signal ranges to determine whether (1) to shift the motor speed to a lower velocity, (2) to actuate a dynamic brake in the DC motor, and (3) to display whether the desired torque has been exceeded.

The servo controller 30 used in the preferred embodiment of the present invention is generally referred to as the LC-4 series manufactured by Automation, Inc., and is of a commercially available type well known in the art. This controller provides speed control, start/stop, and brake functions to a brushless DC motor in response to inputs at specific terminals thereof.

The comparator circuits 40, 42, and 44 are of the type commonly known in the art, are commercially available, and in the preferred embodiment employ high speed opto-isolators. In the first comparison performed in comparator 40, a first threshold level of torque is detected by comparing a predetermined level against the amplified strain gauge output. The output of this comparator is fed to a first input 50 to the servo controller, to cause the controller, in response, to slow the DC motor and thereby reduce the momentum of the tool. In the second comparison, the applied torque is measured against a target value representing the target torque. The amplified strain gauge output is compared in the comparator 42 against a second predetermined level, representing the target torque. When it is reached, the comparator supplies an output via a second input 52 to the controller. In response the controller acts to terminate the power and activate the dynamic brake function, to stop the motor. By using the motor brake function and working directly with the analog signal, this control system works to cause the device to stop quickly; and therefore errors in the final torque delivered is minimized.

In a further aspect of the invention, the operation of the appliance is displayed. Particularly, the amplified strain gauge signal representing the applied torque is processed via a peak/hold circuit 60, an analog-to-digital converter 62, and a digital display 64. The peak/hold circuit is commonly known in the industry and maintains at its ouput the peak of the signal fed to its input. The digital conversion and digital display are, likewise, well known in the industry, and are coupled to the peak/hold to convert the peak signal to digital form and to display it. This displays the current applied torque during a cycle and provides the digital information for records and computer analysis. In between cycles the display would be reset, as for example by a one-shot circuit or manually.

Display, by use of lights 70 and 72, is used to indicate the operation of the comparator circuits 42 and 44 respectively. Particularly, light 70 is illuminated when the output of comparator 42 is providing an operational signal to the controller. This corresponds to the point when the target torque has been reached and the braking of the motor is initiated. Light 72 is illuminated when the comparator 44 detects a signal beyond a predetermined acceptable range. Particularly, the comparison signal is set at the upper limit of the allowable torque and compared against the amplified strain gauge signal representing the applied torque. An operational signal is then provided at the comparator output to illuminate the light when the applied torque exceeds this limit, to provide a warning to the operator.

From the foregoing description, it will be apparent that modifications can be made to the apparatus and method for using same without departing from the teaching of the present invention. Accordingly, the scope of the invention is only to be limited as necessitated by the accompanying claims.

I claim:

1. In an electrically operated device for turning nuts onto bolts, the device including a motor, a strain gauge coupled to the shaft of the motor for measuring torque delivered by the shaft, nut engaging means coupled to the shaft, and a power source for supplying electric power to the motor, the improvement comprising electronic analog control means for regulating power supplied to the motor in response to the output of the strain gauge, said electronic analog control means comprising:

first electronic comparator means coupled to the strain gauge for sensing a first predetermined output from the strain gauge, said first predetermined output from the stain gauge corresponding to a fraction of a desired torque;

second electronic comparator means coupled to the strain gauge for sensing a second predetermined output from the strain gauge, said second predetermined output from the stain gauge corresponding to the desired torque; and electronic control circuitry coupled to the power source, said electronic control circuitry being coupled to said first and second electronic comparator means and responsive thereto for providing a primary power input to the motor to achieve a first predetermined constant shaft velocity in response to said first electronic comparator means not sensing said first predetermined output from the strain gauge, a secondary power input to the motor to achieve a second predetermined constant shaft velocity less than said first predetermined constant shaft velocity in response to said first electronic comparator means sensing said first predetermined output from the strain gauge and for terminating power to the motor and applying a braking action to the motor in response to said second electronic comparator means sensing said second predetermined output from the strain gauge.

2. The device of claim 1 further comprising analog to digital electronic means coupled to said strain gauge output for converting said strain gauge output into a digital representation, and further comprising means for displaying said digital representation.

3. The device of claim 2 further comprising a peak/hold electronic circuit coupled to said strain gauge output for detecting the peak of said strain gauge output and holding this value, and wherein the output of said peak/hold circuit is coupled to said analog to digital electronic means.

4. The device of claim 3 further comprising electronic means for resetting said peak/hold circuit between cycles of operation.

5. The device of claim 4 wherein said means for resetting comprises a one shot circuit.

6. The device of claim 1 further comprising:

indication means coupled to said second electronic comparator means for providing an indication in response to said second electronic comparator means sensing said second predetermined output from the strain gauge.

7. In an electrically operated device for turning nuts onto bolts, the device including a motor, a strain gauge coupled to the shaft of the motor for measuring torque delivered by the shaft, nut engaging means coupled to the shaft, and a power source for supplying electric power to the motor, the improvement comprising electronic analog control means for regulating power supplied to the motor in response to the output of the strain gauge, said electronic analog control means comprising:

first electronic comparator means coupled to the strain gauge for sensing a first predetermined output form the strain gauge, said first predetermined output from the stain gauge corresponding to a fraction of a desired torque;

second electronic comparator means coupled to the strain gauge for sensing a second predetermined output form the strain gauge, said second predetermined output from the stain gauge corresponding to the desired torque;

electronic control circuitry coupled to the power source, said electronic control circuitry being coupled to said first and second electronic comparator means and responsive thereto for providing a primary power input to the motor to achieve a first shaft velocity in response to said first electronic comparator means not sensing said first predetermined output from the strain gauge, a secondary power input to the motor to achieve a reduced second shaft velocity in response to said first electronic comparator means sensing said first predetermined output from the strain gauge and for terminating power to the motor and applying a braking action to the motor in response to said second electronic comparator means sensing said second predetermined output from the strain gauge;

third electronic comparator means coupled to the strain gauge for sensing a third predetermined output form the strain gauge, said third predetermined output from the stain gauge corresponding to a torque greater than the desired torque; and indication means connected to said third electronic comparator means for providing an indication in response to said third electronic comparator means sensing said third predetermined output from the strain gauge.

8. A electrically operated device for turning screw fasteners comprising:

a motor having a drive shaft;

an engaging means coupled to said drive shaft for engaging a screw fastener;

a strain gauge coupled to said drive shaft for generating an analog torque signal corresponding to the torque delivered by said drive shaft;

a first comparator coupled to said strain gauge for detecting when said torque signal indicates said drive shaft is delivering torque exceeding a first predetermined torque, said first predetermined torque being a fraction of a desired torque;

a second comparator coupled to said strain gauge for detecting when said torque signal indicates said drive shaft is delivering torque exceeding a second predetermined torque, said second predetermined torque corresponding to the desired torque;

an electronic control circuit connected to said motor, and said first and second comparators for providing a primary power input to said motor to achieve a first shaft velocity in response to said first comparator not sensing said first predetermined torque, providing a secondary power input to said motor to achieved a reduced second shaft velocity in response to said first comparator sensing said first predetermined torque, and terminating power to said motor and applying a braking action to said motor in response to said second comparator means sensing said second predetermined torque;

a third comparator coupled to said strain gauge for detecting when said torque signal indicates said drive shaft is delivering torque exceeding a third predetermined torque, said third predetermined torque being greater than the desired torque; and an indicator means coupled to said third comparison means for providing an indication in response to said third comparator sensing said third predetermined torque.

9. The electrically operated device for turning screw fasteners as claimed in claim 8, further comprising:

a peak/hold circuit coupled to said strain gauge output for detecting and holding the peak of said torque signal;

an analog to digital converter coupled to said peak/hold circuit for converting the detected peak torque into a digital representation; and a digital display device connected to said analog to digital converter for providing a digital display of said digital representation.

10. The electrically operated device for turning screw fasteners as claimed in claim 9, further comprising:

a one shot circuit coupled to said peak/hold circuit for resetting said peak/hold circuit between cycles of operation.

* * * * *